US012098012B2

(12) United States Patent
White et al.

(10) Patent No.: US 12,098,012 B2
(45) Date of Patent: Sep. 24, 2024

(54) FOOD PRODUCT PACKAGING

(71) Applicant: West Liberty Foods, LLC, West Liberty, IA (US)

(72) Inventors: Brian White, West Liberty, IA (US); Jeff Farver, West Liberty, IA (US); Gerald Lessard, West Liberty, IA (US)

(73) Assignee: West Liberty Foods, LLC, West Liberty, IA (US)

( * ) Notice: Subject to any disclaimer, the term of this patent is extended or adjusted under 35 U.S.C. 154(b) by 0 days.

(21) Appl. No.: 18/178,951

(22) Filed: Mar. 6, 2023

(65) Prior Publication Data

US 2023/0294899 A1 Sep. 21, 2023

Related U.S. Application Data

(63) Continuation of application No. 16/948,637, filed on Sep. 25, 2020, now Pat. No. 11,597,572.
(Continued)

(51) Int. Cl.
*B65D 77/20* (2006.01)
*B65B 31/02* (2006.01)
*B65D 81/20* (2006.01)

(52) U.S. Cl.
CPC ..... *B65D 77/2096* (2013.01); *B65B 31/025* (2013.01); *B65D 81/2076* (2013.01); *B65D 77/2012* (2013.01)

(58) Field of Classification Search
CPC ..... B65D 2501/24; B65D 2217/04; B65D 88/1643; B65D 85/327; B65D 85/325;
(Continued)

(56) References Cited

U.S. PATENT DOCUMENTS 3,580,479 A * 5/1971 Weiss ..... B65D 85/324 206/521.1
3,610,515 A * 10/1971 Voorhis ..... B65D 85/324 206/521.1

(Continued)

OTHER PUBLICATIONS

International Searching Authority in connection with PCT/US2020/052688 filed Sep. 25, 2020, "International Search Report and the Written Opinion of the International Searching Authority, or the Declaration", 13 pages, mailed Jan. 25, 2021.

(Continued)

*Primary Examiner* — Kareen K Thomas
(74) *Attorney, Agent, or Firm* — McKee, Voorhees & Sease, PLC

(57) ABSTRACT

Food products can be stored and sold in packaging. For example, a perishable food product can be stored in a first compartment of a packaging, and a second food product can be stored in a second compartment. The first compartment can include a modified atmosphere to increase the shelf life of the food product in the first compartment. The second compartment can be under normal atmosphere. This allows a more perishable food product to be stored in the first compartment, and a prepackaged, or otherwise less perishable food product to be separately stored in the second compartment, while extending the shelf life of the food products. The first product could be a sandwich, and the second product be one or more condiments for the sandwich.

10 Claims, 10 Drawing Sheets

Related U.S. Application Data

(60) Provisional application No. 62/906,329, filed on Sep. 26, 2019.

(58) Field of Classification Search
CPC ..... B65D 85/324; B65D 83/0445; B65D 81/3272; B65D 81/3266; B65D 81/3261; B65D 77/2096; B65D 81/2076; B65D 77/2012; B65D 77/2024; B65D 81/3294; B65B 31/025
See application file for complete search history.

(56) References Cited

U.S. PATENT DOCUMENTS 3,655,110 A * 4/1972 Eisenbach ..... B65D 85/324 229/406
3,741,461 A * 6/1973 Hassing-Hansen ..... B65D 85/324 206/521.1
3,933,296 A 1/1976 Ruskin et al.
5,558,798 A 9/1996 Tsai
5,759,650 A * 6/1998 Raines ..... A23L 3/3427 426/123
5,927,501 A * 7/1999 Herbruck ..... B65D 81/3294 206/541
6,048,558 A * 4/2000 Feldmeier ..... B65D 77/0433 426/549
7,217,908 B2 5/2007 Orrico et al.
8,445,043 B2 5/2013 Jackson
8,748,786 B2 6/2014 Birchmeier et al.
10,926,913 B2 2/2021 Allers
2003/0038053 A1* 2/2003 Bramen ..... B65D 83/0445 220/524
2005/0150785 A1 7/2005 Julius et al.
2007/0017845 A1* 1/2007 Tietschert ..... B65D 85/324 206/521.1
2007/0059406 A1 3/2007 Shahsavarani
2008/0254170 A1 10/2008 Darin
2009/0039076 A1 2/2009 Maslowski et al.
2010/0307116 A1 12/2010 Fisher
2016/0325904 A1* 11/2016 VanLoocke ..... B65D 75/5877
2018/0186509 A1 7/2018 Deutsch et al.

OTHER PUBLICATIONS

International Bureau in connection with PCT/US2020/052688 filed Sep. 25, 2020, "International Preliminary Report on Patentability (Chapter I of the Patent Cooperation Treaty)", 8 pages, dated Apr. 7, 2022.

* cited by examiner

FOOD PRODUCT PACKAGING

CROSS REFERENCE TO RELATED APPLICATIONS

This application claims priority under 35 U.S.C. § 119 to provisional patent application U.S. Ser. No. 62/906,329, filed Sep. 26, 2019. The provisional patent application is herein incorporated by reference in its entirety, including without limitation, the specification, claims, and abstract, as well as any figures, tables, appendices, or drawings thereof.

This is a continuation patent application which claims priority under 35 U.S.C. § 120 to U.S. Ser. No. 16/948,637, filed Sep. 25, 2020.

TECHNICAL FIELD

The contents of the disclosure related generally to food product packaging. More particularly, but not exclusively, the contents of the disclosure are directed towards food product packaging, including portions which may be modified atmosphere packaged as well as portions which may be non-modified atmosphere packaged.

BACKGROUND

Modified atmosphere is the practice of modifying the composition of the internal atmosphere of a package (commonly food packages, drugs, etc.) in order to improve the shelf life. The need for this technology for food arises from the short shelf life of food products such as meat, fish, poultry, and dairy in the presence of oxygen. In food, oxygen is readily available for lipid oxidation reactions. Oxygen also helps maintain high respiration rates of fresh produce, which contribute to shortened shelf life. From a microbiological aspect, oxygen encourages the growth of aerobic spoilage microorganisms. Therefore, the reduction of oxygen and its replacement with other gases can reduce or delay oxidation reactions and microbiological spoilage. Oxygen scavengers may also be used to reduce browning due to lipid oxidation by halting the auto-oxidative chemical process.

The modification process generally lowers the amount of oxygen in the headspace of the package. Oxygen can be replaced with nitrogen, a comparatively inert gas, or carbon dioxide.

Problems can arise when food product packaging that includes modified atmosphere also includes additional, separate, pre-packaged food product. This can be in the form of condiments that are packaged with a perishable food product. For example, sandwiches include perishable components, and the modified atmosphere increases the shelf life of the product for shipping, storing, and longer times until use. However, for convenience, condiments (e.g., mayonnaise, ketchup, mustard, butter or margarine, or the like) are added and sold with the sandwich for the consumer to selectively use. The condiments are generally stored in packets, and exposing the packets to the modified atmosphere process can affect the packets, and even cause them to open or burst.

Another way to combine a perishable food product and one or more condiments is to package the products together in a non-modified atmosphere packaging. This could be a bag, a wrap, a foil, film, or the like, which covers or otherwise houses the food product and any condiments. Because this is not fully sealed, the shelf life for the food product is reduced, and there is a higher risk of spoilage and waste.

Therefore, there is a need in the art for an improved food product packaging for perishable food products that allows for the use of modified atmosphere packaging, while also including one or more condiment packets or packages included with the food product that has a high shelf life.

SUMMARY

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

Therefore, it is a primary object, feature, and/or advantage of the invention to improve on or overcome the deficiencies in the art.

It is another object, feature, and/or advantage of the invention to provide systems, methods, and apparatus for providing food packaging for perishable food products.

It is still yet a further object, feature, and/or advantage of the invention to provide food packaging that allows perishable and non-perishable, pre-packaged foods to be shipped and stored together.

It is yet a further object, feature, and/or advantage of the invention for food product packaging to include both a modified atmosphere section and a non-modified atmosphere section.

It is still another object, feature, and/or advantage to provide food packaging that comprises multiple compartments for storing the same or separate food products.

It is still yet a further object, feature, and/or advantage of the invention to provide a safe, cost effective, and durable food product packaging.

It is still yet a further object, feature, and/or advantage of the present invention to provide food product packaging having a distinct aesthetic appearance.

The previous objects, features, and/or advantages of the present invention, as well as the following aspects and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

According to at least some aspects of the invention, a food product packaging includes a first compartment comprising a first pouch and a first cover sealed to the first compartment, and a second compartment connected to the first compartment and comprising a second pouch and a second cover operatively attached to the second pouch, wherein the first sealed compartment comprises a modified atmosphere and the second compartment comprising a non-modified atmosphere.

According to at least some aspects, the first compartment and the second compartment are connected by a hinge.

According to at least some aspects, the hinge comprises a living hinge.

According to at least some aspects, the first cover and the second cover comprise a single piece of material.

According to at least some aspects, the second cover is operatively attached to the second pouch by a plurality of unconnected seals about the periphery of the second pouch.

According to at least some aspects, the food product packaging further comprises a label operatively connected to the packaging.

According to at least some aspects, the first cover is sealed to the first pouch by way of a resealable adhesive.

According to at least some aspects, the food product packaging further comprises one or more pre-cut tear notches at the first and/or second compartment to provide access thereinto.

According to at least some aspects, the first and second compartments comprise a flexible film with a high barrier to moisture and oxygen.

According to at least some aspects, the first cover is positioned between the first and the second compartments.

According to at least some aspects, a method of packaging a food product comprises forming a first compartment and a separate second compartment from a material, loading a first food product into the first compartment, and a second food product into the second compartment, covering the first and second compartments with a cover layer of material, modifying the atmosphere of the first compartment, and then sealing the first compartment to the cover layer, and operatively attaching the cover layer to the second compartment without modifying the atmosphere of the second compartment.

According to at least some aspects, the step of operatively attaching the cover layer to the second compartment comprises a plurality of unconnected seals about the periphery of the second compartment.

According to at least some aspects, the step of modifying the atmosphere of the first compartment comprises:

a. removing the oxygen in the first compartment; and
b. adding a gas mixture to the first compartment in place of the removed oxygen.

According to at least some aspects, the gas mixture is added after the first compartment is at a predetermined pressure.

According to at least some aspects, the method further comprises positioning the first compartment and the second compartment on top of one another.

According to at least some aspects, the first and second compartments are folded on top of one another.

According to at least some aspects, the method further comprises attaching a label to the packaging.

According to at least some aspects, the invention includes, in combination, a food packaging and food in the packaging, with the combination comprising that the food packaging comprising a first compartment comprising a first pouch and a first cover sealed to the first compartment, and a second compartment connected to the first compartment and comprising a second pouch and a second cover operatively attached to the second pouch, wherein the first sealed compartment comprises a modified atmosphere and the second compartment comprising a non-modified atmosphere; and a first, unpackaged food product positioned in the first compartment, and a second, packaged food product positioned in the second compartment.

According to at least some aspects, the first food product comprises a sandwich.

According to at least some aspects, the second food product comprises a packaged condiment.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

Figure 1:
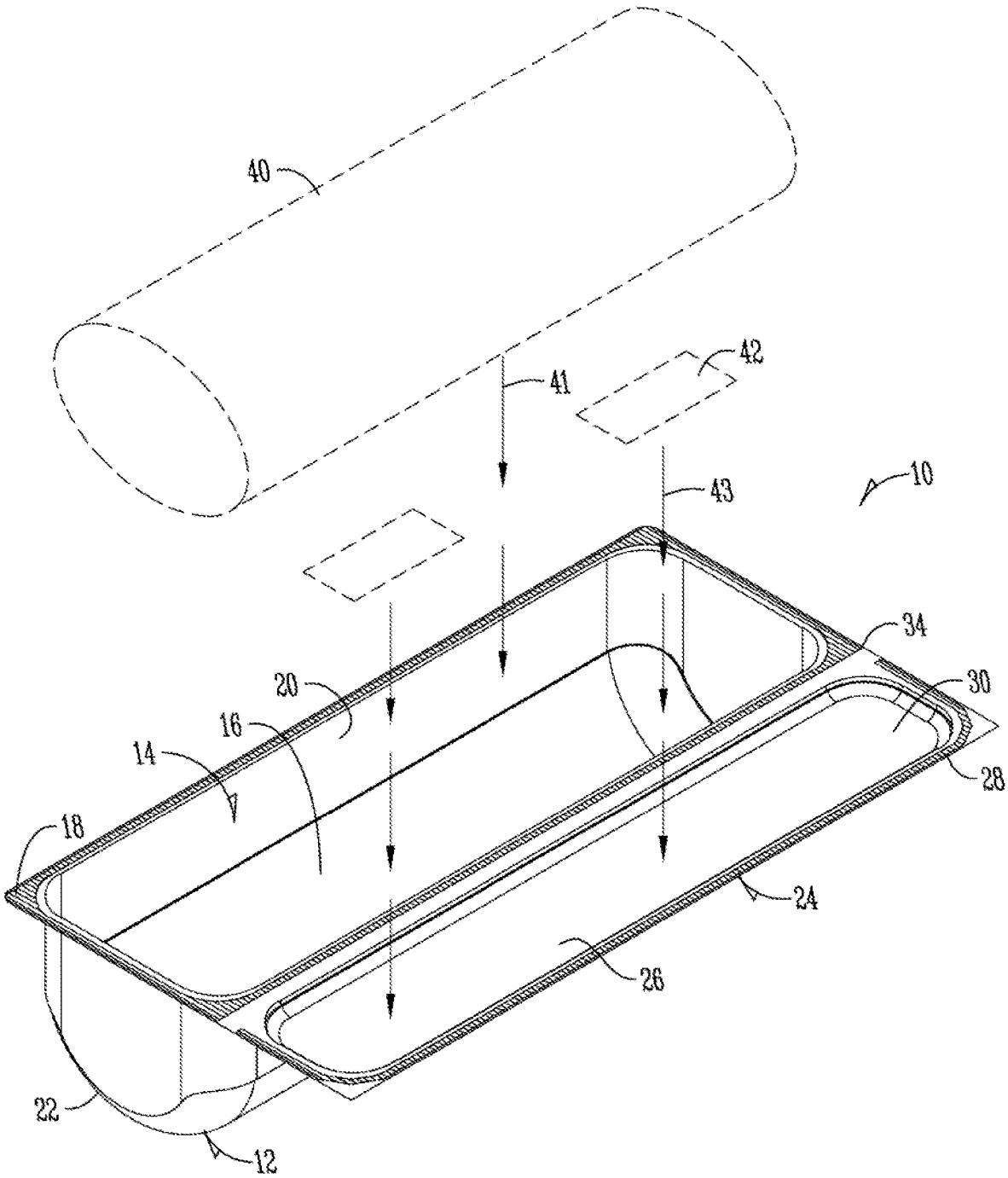
FIG. 1 is a perspective view of a product package and potential products for use with the package according to exemplary aspects of the disclosure.

Several embodiments in which the present invention may be practiced are illustrated and described in detail, wherein like reference characters represent like components throughout the several views. The drawings are presented for exemplary purposes and may not be to scale, unless otherwise indicated, and thus proportions of features in the drawings shall not be construed as evidence of actual proportions.

DETAILED DESCRIPTION

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include both singular and plural referents.

The term "or" is synonymous with "and/or" and means any one member or combination of members of a particular list.

The terms "invention" or "present invention" as used herein are not intended to refer to any single embodiment of the particular invention but encompass all possible embodiments or components of embodiments as described, explicitly, inherently, or incorporated by reference in the specification and the claims.

The term "about" as used herein refers to slight variations in numerical quantities with respect to any quantifiable variable. One of ordinary skill in the art will recognize inadvertent error can occur, for example, through use of typical measuring techniques or equipment or from differences in the manufacture, source, or purity of components. The claims include equivalents to the quantities whether or not modified by the term "about."

The term "configured" describes an apparatus, system, or other structure that is constructed to perform or capable of performing a particular task or to adopt a particular configuration. The term "configured" can be used interchangeably with other similar phrases such as constructed, arranged, adapted, manufactured, and the like.

Terms characterizing a sequential order (e.g., first, second, etc.), a position (e.g., top, bottom, sides, forward, aft, etc.), and/or an orientation (e.g., width, length, depth, thickness, vertical, horizontal, etc.) are referenced according to the views presented. Unless context indicates otherwise, these terms are not limiting. The physical configuration of an object or combination of objects may change without departing from the scope of the present invention.

Embodiments described in the present disclosure are directed towards various apparatus, methods, systems of product packaging. The product packaging is considered to hold one or more products, such as food products. For example, the product packaging may hold one or more perishable and/or non-perishable food products in one or more than one compartments or pouches of the product packaging. Still further, it is to be appreciated that, according to any of the embodiments described in the present disclosure, the food packaging may have one or more compartments that are modified atmosphere package compartments. Modified atmosphere involves modifying the composition of an internal atmosphere of a compartment of the package in order to improve the shelf life of a perishable or non-perishable product stored therein. As is known, the methods involved with modified atmosphere packaging involve removing amounts of oxygen in a compartment of a package and replacing with another gas, such as an inert gas, specially chosen gas to maintain the product, or the like. The removal of the oxygen will increase the shelf life of the food products stored therein. In addition, while food products have been disclosed, it should be appreciated that other products could utilize any of the packaging disclosed herein, wherein it is desirable to extend the shelf life of a product stored in one or more of the compartments of the packaging and to mitigate the effects of oxidation on said products stored therein. Therefore, it is to be appreciated that the packaging disclosed according to any of the embodiments described in the present disclosure are not to be limited in any way to a product type that is to be stored in one or any of the compartments, pouches, or portions of the package, including and not limited to the modified atmosphere portion as well as the non-modified atmosphere portion.

Therefore, in order to provide a better understanding of the invention, exemplary embodiments will be disclosed. It should be appreciated that any portion, component, aspect, and/or feature of any of the embodiments disclosed herein are to be interchangeable with any of the other embodiments disclosed. The Figures disclosed are not to be limiting in that any portion of the Figures (both shown and described) can be attributable and useable with any of the other figures to provide a greater number of possible embodiments covered by the present disclosure. Furthermore, while examples will be provided in terms of product type stored in the packaging, it should be appreciated that additional products considered by those skilled in the art and which will benefit from any of the aspects of any of the packaging disclosed in the present disclosure will be considered part of the present disclosure.

FIGS. 1-5B provide a product packaging 10 according to aspects of the present disclosure. The packaging 10 shown in the figures comprises a film 12. The film 12 maybe a flexible film that is formed into a first compartment 14 and a second compartment 24, such as by temperature, pressing, extruding, or any other process. Examples of types of films maybe be polymers, plastics, hybrid materials, or the like. For exemplary purposes, a film 12 with a high barrier to moisture and oxygen may be used. It is noted that the term "high barrier" may be defined by industry standards, such as by third-party vendors. However, depending on the product being packaged, other type of films could be used and are to be considered part of the invention. For example, the film could include a hydrophobic element to mitigate the moisture from passing therethrough.

The first compartment is formed into a portion of the film 12 and includes an open end 20 and an opposite closed end 22. A first flange 18 provides a peripheral rim around the general open end 20, thus defining a first pouch 16. The size, shape, depth, orientation, and the like of the first compartment 14, including the pouch 16 maybe be determined upon by the shape, number, or other aspects of the product being stored therein. For exemplary purposes, a sandwich 40 is shown being positioned and stored in the first compartment 14 of the package 10 in FIG. 1, and therefore, the shape, size, depth, and orientation of the first compartment 14 has been shown to receive a said sandwich 40. In particular, the sandwich 40 is a hoagie type sandwich. However, as will be appreciated, the packaging 10 can be utilized and store generally anytime of sandwich, as well as other food products.

As shown in the figures, the product package 10 includes a second compartment 24 which may also be referred to as a header 24. The second compartment 24 is formed in the film 10 to form a second pouch 26. The pouch 26 includes an open end 30, a closed end 32, and a flange 28 generally surrounding the periphery of the open end 30 of the pouch 26. As is noted from the figures, the second pouch 26 of the second compartment 24 has a much less depth compared to the first pouch 16. Again, referring to the example disclosed herein, when a sandwich 40 is included in the first pouch, one or more condiment packets 42 may be stored in the second compartment 24. The condiment packets 42 are generally much smaller than the sandwich 40, and therefore require less room for storage in the product packaging 10. However, if additional condiments were to be included, or if additional food product were to be stored (e.g. additional condiments, additional shape condiments, utensils, cutlery, napkins, packaged beverages, or the like) the second compartment 24 and second pouch 26 could have additional shapes, depth, and/or sizes, and even could substantially match or be bigger than the first compartment 14.

As shown in the figures, the first compartment 14 and second compartment 24 are formed from a common film 12 and thus connected by a hinge 34. The hinge in the figures as shown to be a living hinge 34, such that the living hinge is a portion of the packaging 10 itself. However, it should be appreciated that the first and second compartments 14, 24 need not be formed from a common material or piece of material, and also need not to be connected by film such that they could be separable or separated components that are joined by an independent hinge, as will be understood herein.

Another layer of film in the form of a cover is placed over the open portions 20, 30 of the first and second compartments 14, 24. The cover could take the form of a single piece of film material or could be separable cover portions 36, 38. For the purposes of the present disclosure, whether the cover is a single piece of film or separate pieces of film covering the first and second open portions 20, 30 of the first and second compartments respectively 14, 24, the covers will be referred to by a first cover 36, which is to be understood to cover the first compartment 14 and a second cover 38, which is to be understood to be covering the second compartment 24. The cover material also comprises a film that has a high barrier to moisture and oxygen, but could also comprise other types of films depending on the product in packaging needs. In addition, the cover could be different materials, including, but not limited to, paper, glass, tinfoil or tin, other metals, wrap, or other materials capable of closing the compartments.

The first cover can be connected to the first compartment about the first flange 18. When the food product in the first compartment is perishable, and the first compartment 24 is a modified atmosphere compartment, the first cover 36 can be sealed about the first flange 18 such that it is fully or at least substantially sealed about the periphery of the open portion 20 of the first compartment 14. However, if the compartment is not fully modified atmosphere, the first cover 36 can be attached to the first flange in a non-continuous sealing manner.

The second cover 38 can be connected to the second flange 28 of the second compartment 24 such that there is a plurality of unconnected seals about the periphery of the open end 30 in flange 28 of the second compartment 24. When pre-packaged condiment packets are to be stored in the second compartment 24, there is less of a need for modified atmosphere in the second compartment 24, and thus, the second compartment 24 need not to be fully sealed to prevent or otherwise litigate oxygen exposure therein. However, as will be understood herein, the second compartment 24 could be fully sealed and possibly gas flushed if desired.

Figure 2A:
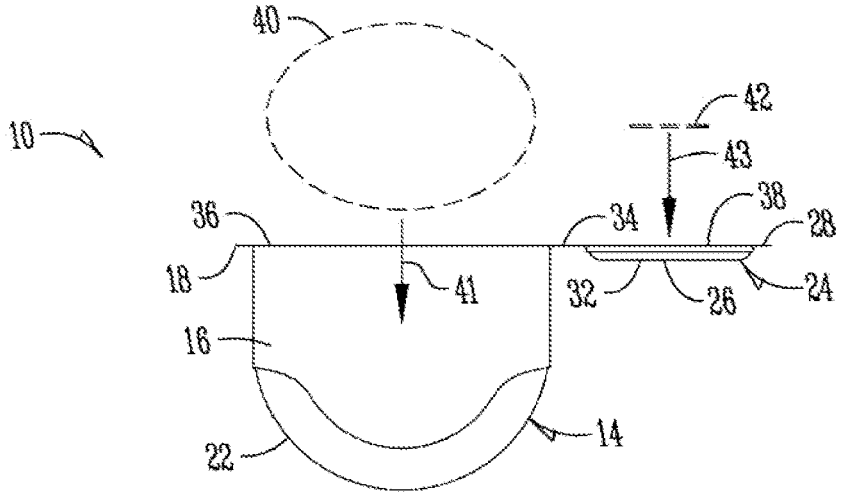
FIG. 2A is an end view of the product package and product of FIG. 1 before the product has been added to the package.
Figure 2B:
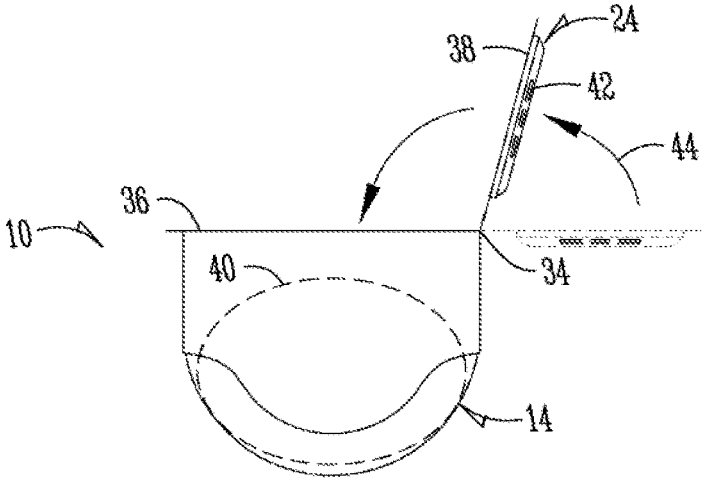
FIG. 2B is an end view similar to FIG. 2A, but with the products in the package.
Figure 2C:
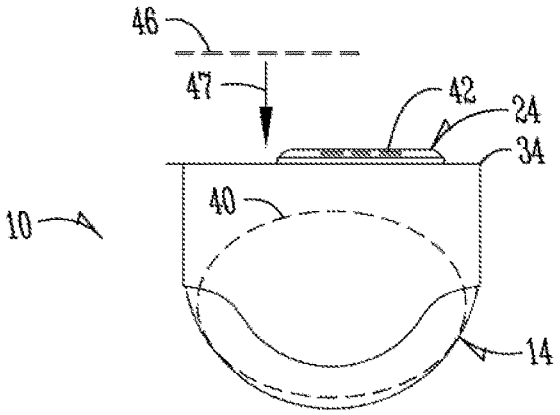
FIG. 2C is an end view similar to FIGS. 2A and 2B, with the product in the package and the package folded and ready to be held in the folded configuration.

As shown in the figures, and in particularly in FIGS. 2*a*, 2*b*, and 2*c*, the hinge 34 connecting the first compartment 14 and the second compartment 24 allow for the first and second compartments to be folded upon one another, thus reducing the footprint and/or size of the overall product packaging 10. The unfolded product packaging 10 is shown in FIGS. 1, 2*a*, 4*a*, and 5*a*, and this matter, the flanges 18, 28 are generally in line with one another and can be considered about a common plane. However, once the compartments are filled with a product, in order to reduce the overall size of the packaging 10, the first and/or second compartment can be folded upon the other compartment such that the first and second covers 36, 38 are generally in mating engagement or otherwise close to mating engagement. This is shown in FIGS. 2*c*, 3, 4*b*, and 5*b*.

Figure 3:
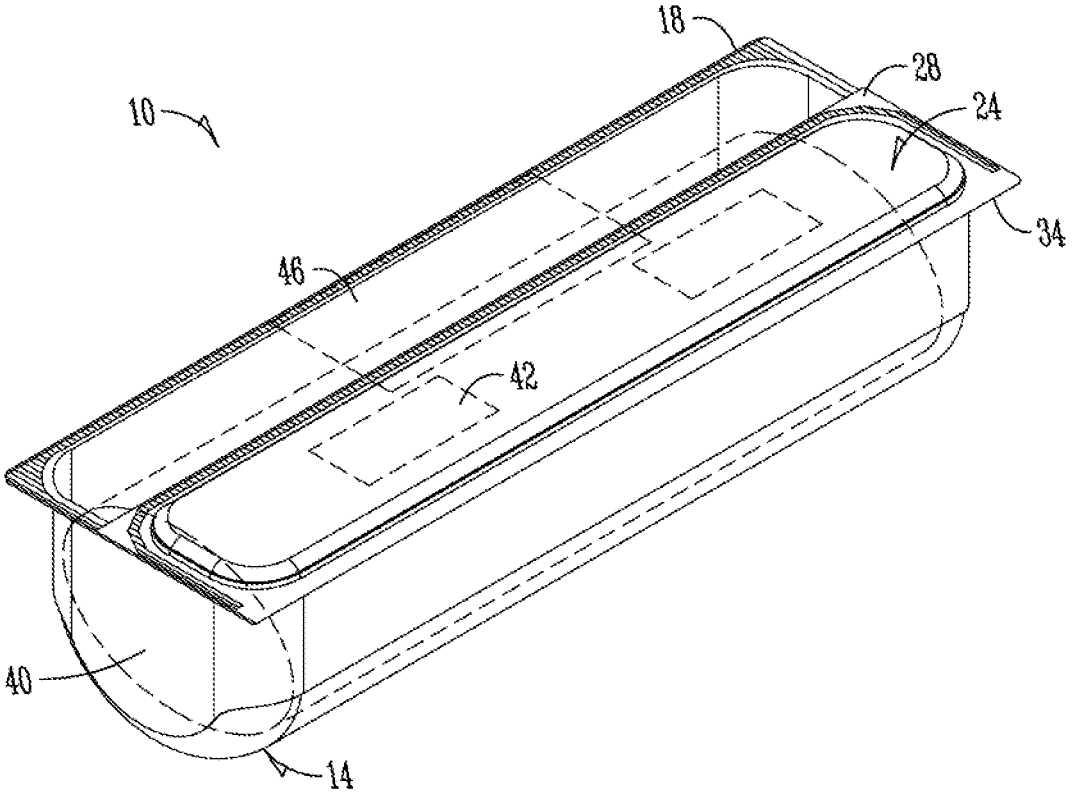
FIG. 3 is a perspective view of the product package with an exemplary product therein, and in a folded and ready-to-distribute configuration.

Furthermore, once the second and first compartments are folded upon one another, the compartments can be held in place in said configuration until such time that the packaging is to be opened. As shown in FIGS. 2*c* and 3, a member 46 can be utilized to hold the packaging in place in said folded configuration. The member 46 can take many forms, including an adhesive, a label, a tying element, an elastic element around the portions, or the like. For example, the label 46 can include nutritional information, ingredients, advertising, type of product, and generally any other information related to the product or products stored in the packaging, as well as the packaging itself. The label 46 can be placed to cover at least a portion of the second compartment 24 with an adhesive side towards the packaging, thus attaching the second compartment 24 to the first compartment 14. As shown in FIG. 2*c* from an end of the packaging, the folding of the second compartment 24 on the first compartment 14 greatly reduces the width of the packaging, allowing for a much cleaner look thereof.

Therefore, as shown in the figures according to the product packaging 10, the following processes and structures are utilized to form an exemplary product packaging 10 and including a food product therein. As disclosed, a flexible film is formed into two compartments of the packaging 10. When a sandwich is to be stored in the packaging 10, the film can comprise a material with a high barrier to moisture and oxygen. A sandwich 40 can be inserted into the first pouch 16 of the first compartment 14, such as according to the arrow 41 in the figures. The pouch 16 of the compartment 14 is sized large enough to allow the sandwich 40 to be housed therein. One or more condiment packets 42 can be placed in the second pouch 26 of the second compartment 24, such as shown by the arrows 43. Another layer of film is placed over the open portions of the first and second compartments the second layer of film can also have a high barrier to moisture and oxygen.

The first compartment 14 which includes the sandwich 40 can then be placed under vacuum to reduce the oxygen per shelf-life purposes. This is the process of modifying the atmosphere in the first compartment 14. Once a predetermined vacuum pressure is reached, a gas mixture can be added back into the package to fully modify the atmosphere in the first compartment 14. Exemplary gases or gas mixtures could be, but are not limited to, be nitrogen, carbon dioxide, a mix of the two, or some other type of inert gas. As the condiments 42 are pre-packaged, the second compartment 14 is isolated from the first compartment 14 such that it is not placed under vacuum to limit the impact of the condiment packages being exposed to the vacuum. This mitigates any structural damage to the condiment packages during the modified atmosphere process for the first compartment 14. Thus, the first compartment 14 is a modified atmosphere compartment, while the second compartment 24 is a non-modified atmosphere compartment.

The two compartments are then sealed, which involves sealing the film cover about the flange 18 and flange 28 of the first and second compartments, respectively. According to exemplary packages, the first compartment is fully sealed about the flange 18. This seal, along with the modified atmosphere from the vacuum and gas flush, provides for improved product self-life compared to simply wrapping the sandwich for including a non-modified atmosphere for a sandwich. The second compartment 24 can comprise small unsealed areas about the periphery of the flange 28 to allow air to escape the second compartment 24, which minimizes the final thickness of the compartment 24. Thus, the thickness of the compartment 24 maybe be dictated by the thickness of the product packaging therein.

After sealing the compartments, the second compartment 24 can be folded towards the first compartment 14, such as shown by the arrow 44 in FIG. 2*b*. The folding can be about the living hinge 34 such that the cover portions 36, 38 of the first and second compartments 14, 24 maybe touching in a mating manner. However, it should be appreciated that the packaging 10 could also be folded in the opposite direction or left unfolded as well. However, the folding of the second compartment 24 towards the first compartment gives a final package 10 a wrapped appearance, which gives a somewhat familiar look to current packaging that does not include any modified atmosphere compartments.

Still further, as is shown in FIG. 2*c*, a label 46 can be added to the package 10 and covering a portion of both the first compartment 14 and the second compartment 24. Said label can include an adhesive on one side to adhere to the portions of the package in order to hold the compartments in the folded configuration, such as shown in FIG. 3. Furthermore, the labeling can include information, such as nutritional information, ingredient list, ownership information, and/or other marketing information relevant to the product stored therein. The size, shape, and number of labels can be varied according to the product being packaged, and should not be limiting to the invention therein.

Figure 4A:
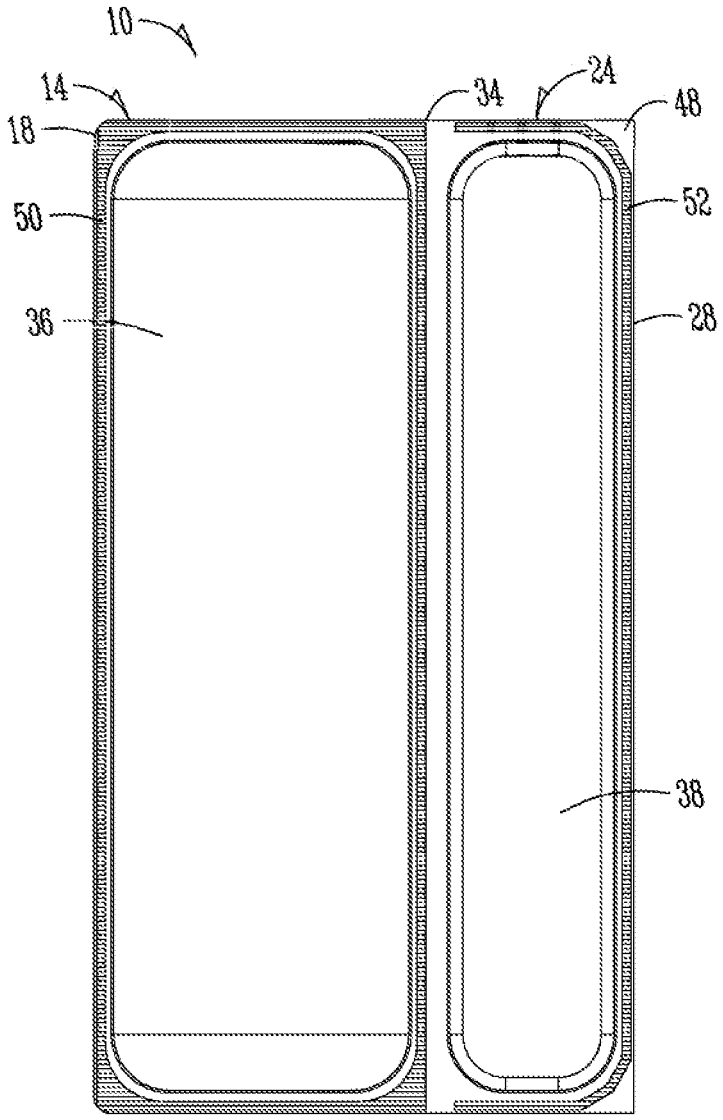
FIG. 4A is a top, plan view of the product package of FIG. 1 without any product in a non-folded configuration.
Figure 4B:
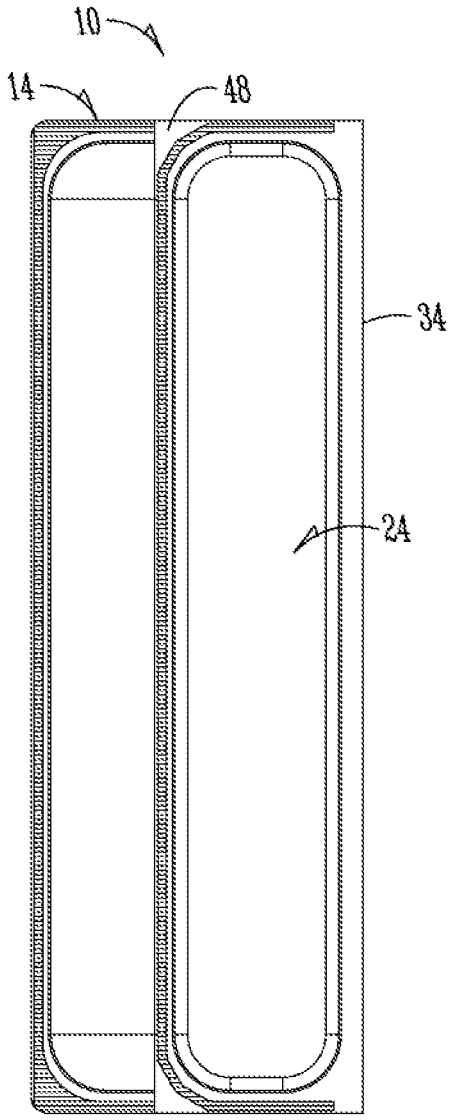
FIG. 4B is a top, plan view of the product package of FIG. 1 without any product in a folded configuration.
Figure 5A:
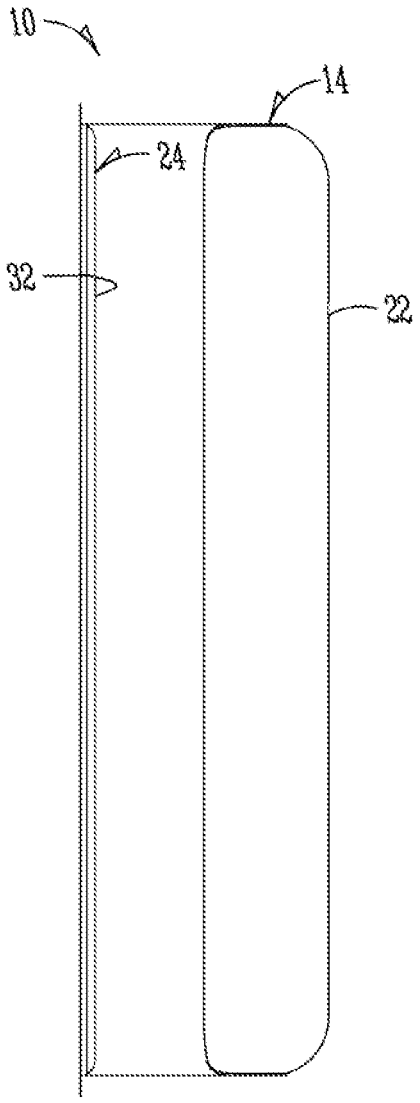
FIG. 5A is a side, elevation view of the product package of FIG. 1 without any product in a non-folded configuration.
Figure 5B:
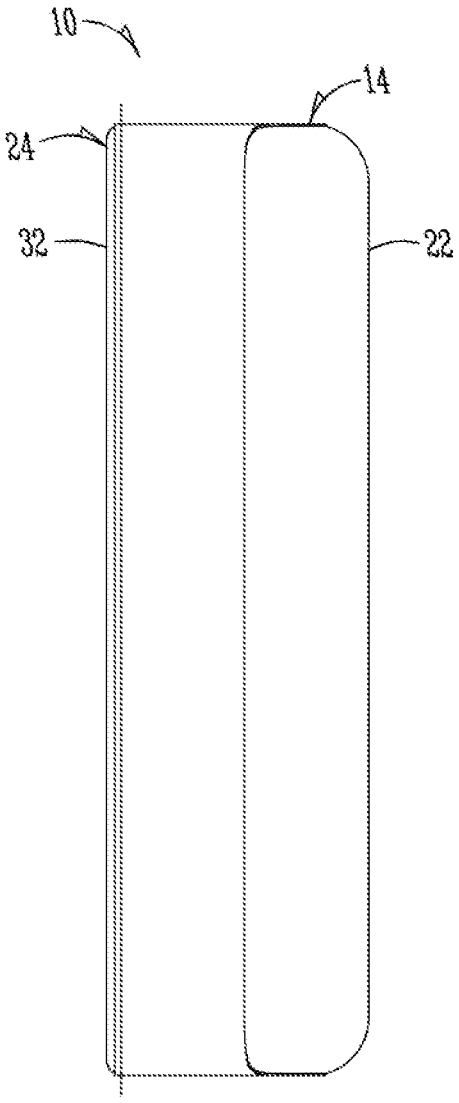
FIG. 5B is a side, elevation view of the product package of FIG. 1 without any product in a folded configuration.
Figure 6:
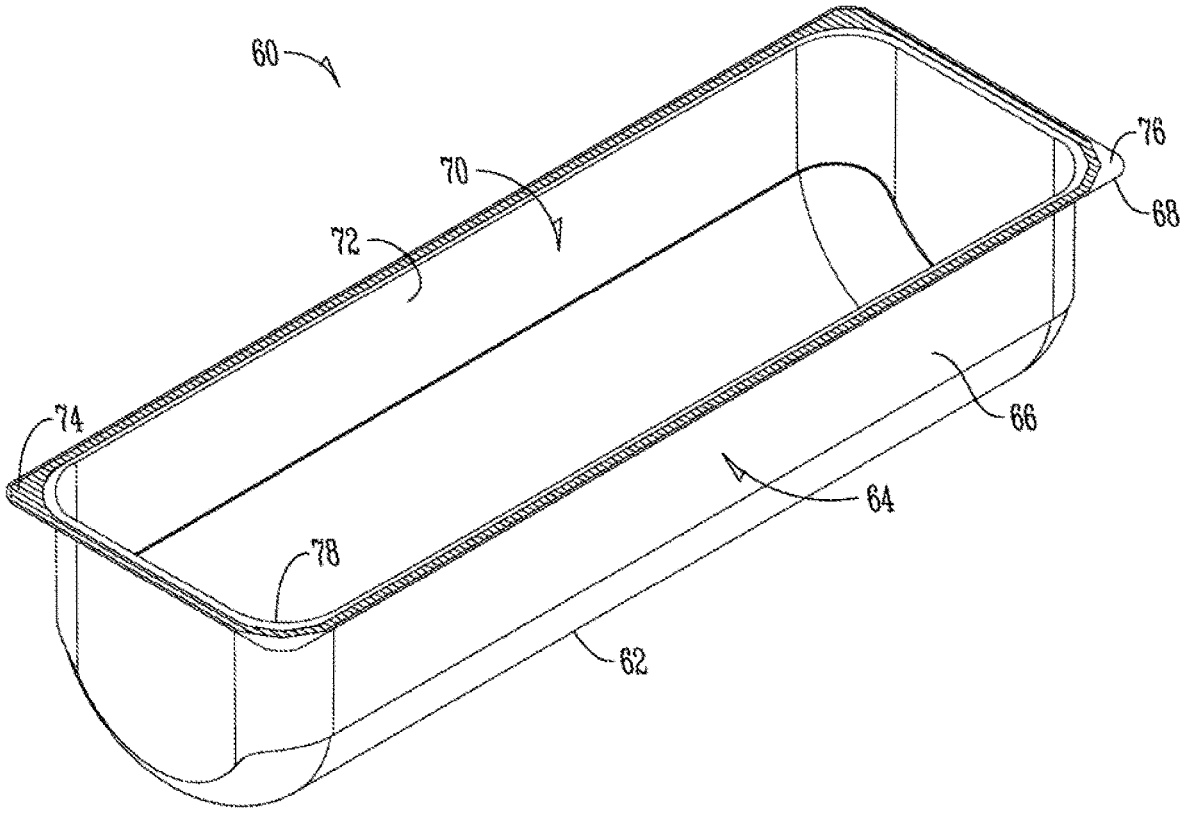
FIG. 6 is a perspective view of another product package according to exemplary aspects of the present disclosure.
Figure 7:
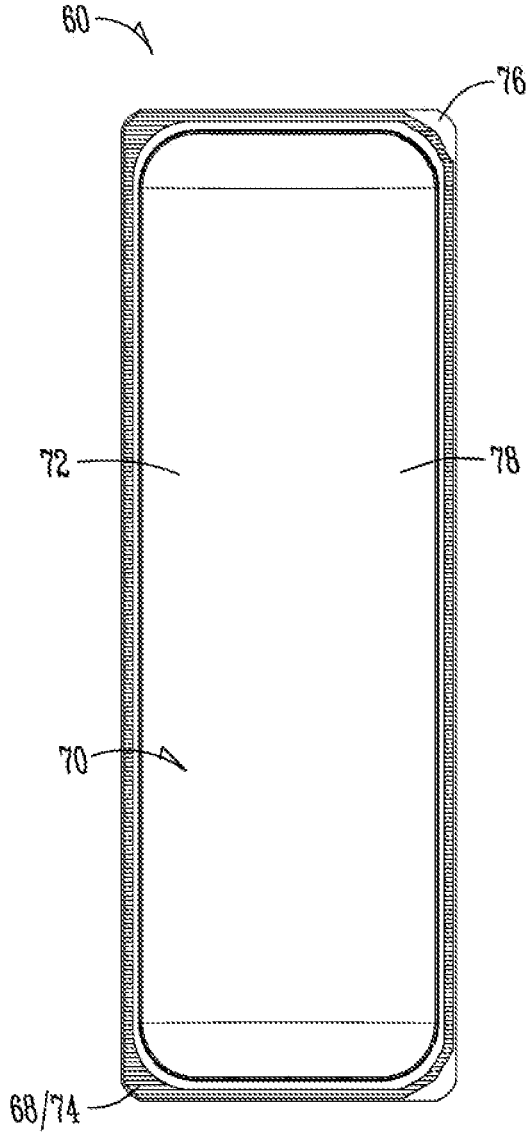
FIG. 7 is a top, plan view of the product package of FIG. 6.
Figure 8:
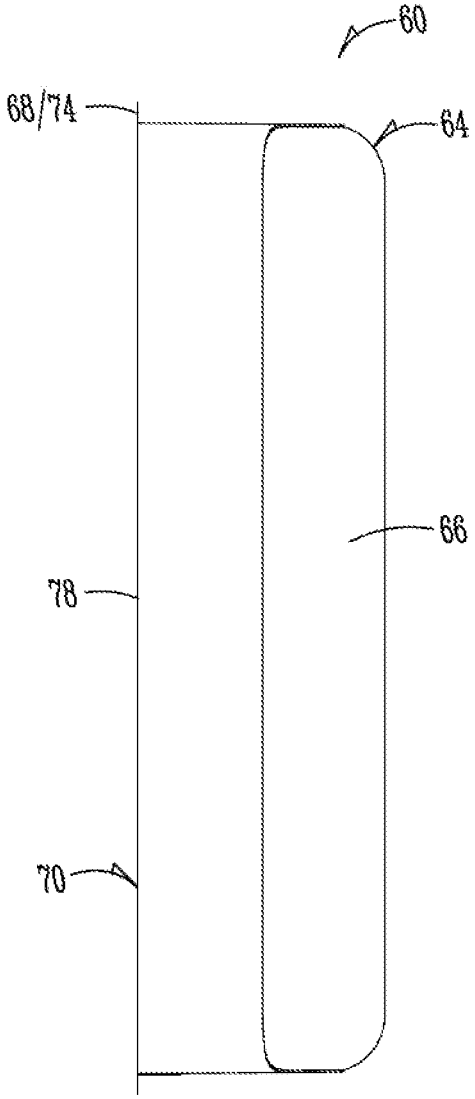
FIG. 8 is a side, elevation view of the product package of FIG. 6.
Figure 9:
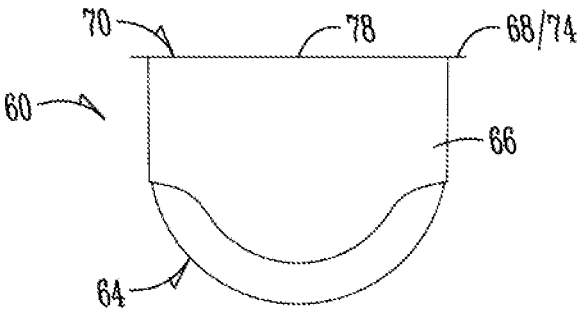
FIG. 9 is an end view of the product package of FIG. 6.

Thus, the package, such as shown in FIGS. 3, 4*b*, and 5*b* is a clean look, which reduces the footprint needed, and gives a familiar appearance of a wrapped sandwich. However, because of the modified atmosphere compartment holding the sandwich, and the non-modified atmosphere compartment holding the condiments, the self-life of the product in the packaging 10 will be extended beyond current packaging capabilities.

Furthermore, upon use of the packaging, a user can simply remove or tear the label to unfold the first and second compartments from one another. In addition, the final package can have corners 48 which can be unconnected in a sealing engagement to allow for a peeling of the cover from the first and second compartments, providing access to the product therein. Alternatively, tear notches can be included in the cover, first compartment, and/or second compartment. The tear notches can allow for perforated portions that can be easily opened upon desired entrance to the product packaging. Additional options may include that the sealing engagement of the cover to the first and/or second compartments can be done in a way that allows for reseal. The reseal could be done by adhesive-like material, which can hold the film cover to the flange portions of the packaging, but become easily disengaged therefrom. However, if a user wants to repackage any unused product, the reseal would allow the cover to be reattached to the flange and to hold itself thereto in a closed manner.

Furthermore, as is shown in FIGS. 4*a* and 4*b*, the second compartment has a width that is considerably less than that of the first compartment 14. As disclosed, the example provided includes for condiments 42 to be housed in the second compartment 24 and a sandwich 40 to be housed in the first compartment 14. However, if additional condiments or additional components are to be included in the second compartment 24, the size of the compartment, including the width, length, depth, or any other size associated with the second compartment, could be adjusted to account for the additional components to be stored therein.

FIGS. 6-9 disclose an additional embodiment of product packaging 60 according to aspects of the invention. The product packaging 60 shown in FIGS. 6-9 can be formed from a film 62. A first compartment 64 is formed in the film and includes a first pouch 66 which is extended from a first flange 68 about a periphery of the first pouch 66. The package 60 also includes a second compartment 70. Instead of the second compartment being extended from the first compartment, in the embodiment shown in FIGS. 6-9, an additional layer of film is added to create two compartments. For example, in the embodiment shown in FIGS. 6-9, the package 60 includes the first compartment of a rigid film that may also be a barrier to moisture and/or oxygen and form to hold a sandwich in a first compartment. A film is then placed over the sandwich in the compartment and is slightly depressed towards the sandwich. The first compartment 64 can then be modified to modify the atmosphere therein, such as removing oxygen therefrom and adding an additional gas in place of the oxygen to extend the self-life of the material in the first compartment 64. The film is then sealed to the flange 68 about the first compartment. The film creates a bottom portion for the second compartment 70 and the second compartment 70 includes said pouch 72 that is depressed towards the sandwich and/or the first compartment 64. The upper portion of the film forming the second compartment about the first flange 68 creates a second flange 74 for the second compartment 70. Condiments, utensils, napkins, and/or some combination thereof can then be placed on top of the film in the second compartment 70. Another film in the form of a cover 78 can then be added over the products in the second compartment 70. The cover 78 can be sealed to the second flange 74 in a manner in which the second compartment 74 is a non-modified atmosphere. Therefore, such a package 60 includes three layers of film and can be another manner in which a product such as a sandwich in additional products such as condiments can be stored in a packaging 60 in a manner that appears to be a wrapped manner or other familiar manner to consumers.

In addition, the product packaging 60 includes a modified atmosphere compartment and a non-modified atmosphere compartment. The use of both a modified atmosphere compartment and a non-modified atmosphere compartment allows for perishable product to be stored in the modified atmosphere compartment and pre-packaged or otherwise non-perishable product to be stored in the non-modified atmosphere compartment, which extends the life of the perishable item, while reducing the risk of damage to the pre-packaged or non-perishable product, and thus creating an ideal packaging for mixed perishable and non-perishable product.

Again, the size, shape, and or orientation of the first and/or second compartments 64, 70 of the package 60 can be varied according to the type of product and/or products being stored therein. Furthermore, while a modified and non-modified atmosphere compartment are utilized in the packaging 60, it should be appreciated that both the first and second compartments 64, 70 be modified atmosphere packaging having the same modifications and/or different modifications, depending upon the product stored therein.

Figure 10:
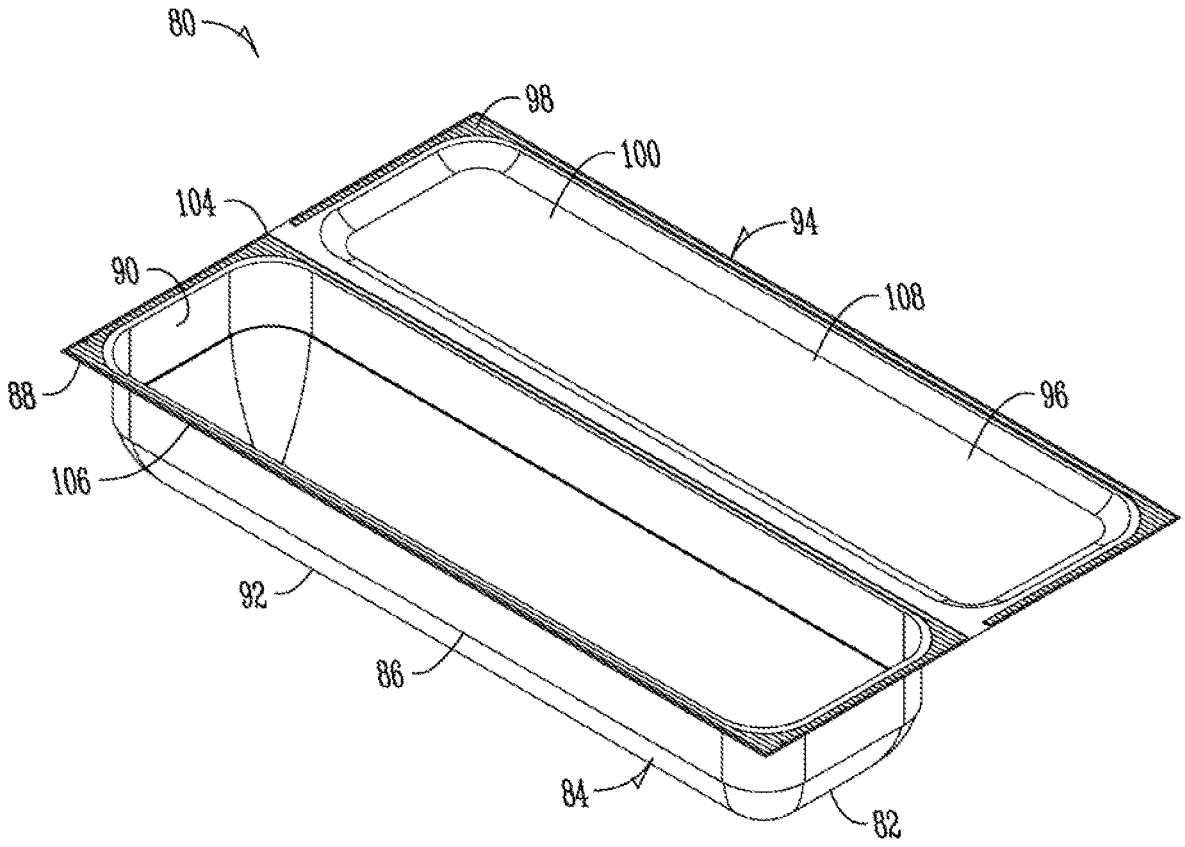
FIG. 10 is a perspective view of another product package according to exemplary aspects of the present disclosure.
Figure 11:
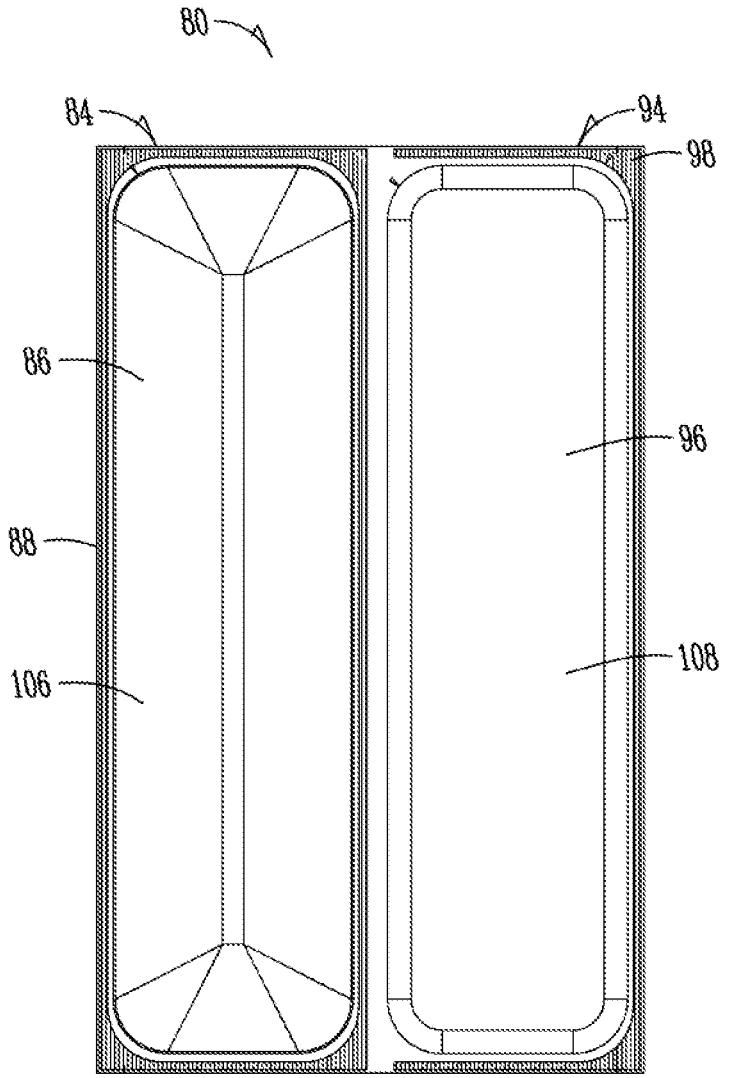
FIG. 11 is a top, plan view of the product package of FIG. 10.
Figure 12:
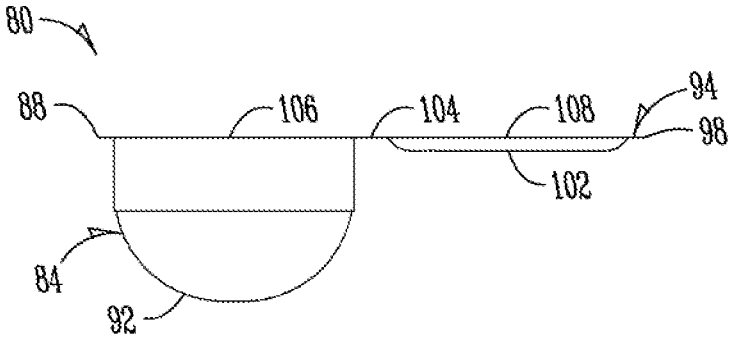
FIG. 12 is an end view of the product package of FIG. 10.

FIGS. 10-12 disclose yet another product packaging 80 according to aspects of the invention. The product packaging 80 in the figures closely resembles the product packaging 10 as has been shown and described herein. However, as will be appreciated, the width of the second compartment 94 of the product packaging 80 is wider than that of the second compartment 24 of the packaging 10. The width of the second compartment 94 of the packaging 80 shown in the figures is close to the width of the first compartment 84 of the packaging 80. Therefore, while the second compartment is folded upon the first and second compartments will be generally mirrored in area of the open ends 90, 100 and the label can then be applied about the edges of the compartments opposite the hinge 104 to hold the compartments together.

In addition, the first compartment 84 includes a first pouch 86 and a first flange 88 about the periphery of the first pouch 86. The first pouch is formed from an opened end 90 and an opposite closed end 92. The distance between the open and closed ends 90, 92 can be variable, such as to accommodate different product stored in house therein. Furthermore, the size, shape, and/or orientation of the open end and flange of the first compartment can be varied according to the use of the packaging 80.

As disclosed, connected via a hinge 104 to the first compartment 84 is a second compartment 94. The second compartment 94 includes a second pouch 96 comprising an open end 100, a closed end 102, and a flange 98 about the periphery of the open end 100. Again, the distance between the open and closed ends can be variable depending upon the product or products stored therein, as well as the size, shape, and/or configuration of the open end and flange, which can be varied according to the desired use of the package and the requirements for the products stored therein. A first and second cover 106, 108 can be positioned over the first and second compartments as a single piece or separate pieces and can be sealed to the first flange 88 and second flange 98 to seal the first compartment 84 separate from the second compartment 94. Similar to that previously disclosed, the first and/or second compartment can be a modified atmosphere compartment in that oxygen be removed and replaced with another gas, such as an inert gas, which can increase the self-life and litigate oxygenation of a product stored therein. Thus, the first compartment 84 can be a modified atmosphere compartment, and the second compartment 94 can be a non-modified atmosphere compartment. Whichever compartment includes a modified atmosphere, said cover can be fully sealed to litigate oxygen from penetrating and entering the modified atmosphere compartment. In addition, the non-modified atmosphere compartment need not to be fully sealed, and can be connected via a plurality of unconnected seals as it is unimportant to prevent or otherwise litigate oxygen from entering the non-modified atmosphere thereof.

Furthermore, a flexible film can be used to comprise the packaging 80 and can include a material that is a barrier to moisture, water, oxygen, or other unwanted materials.

Figure 13:
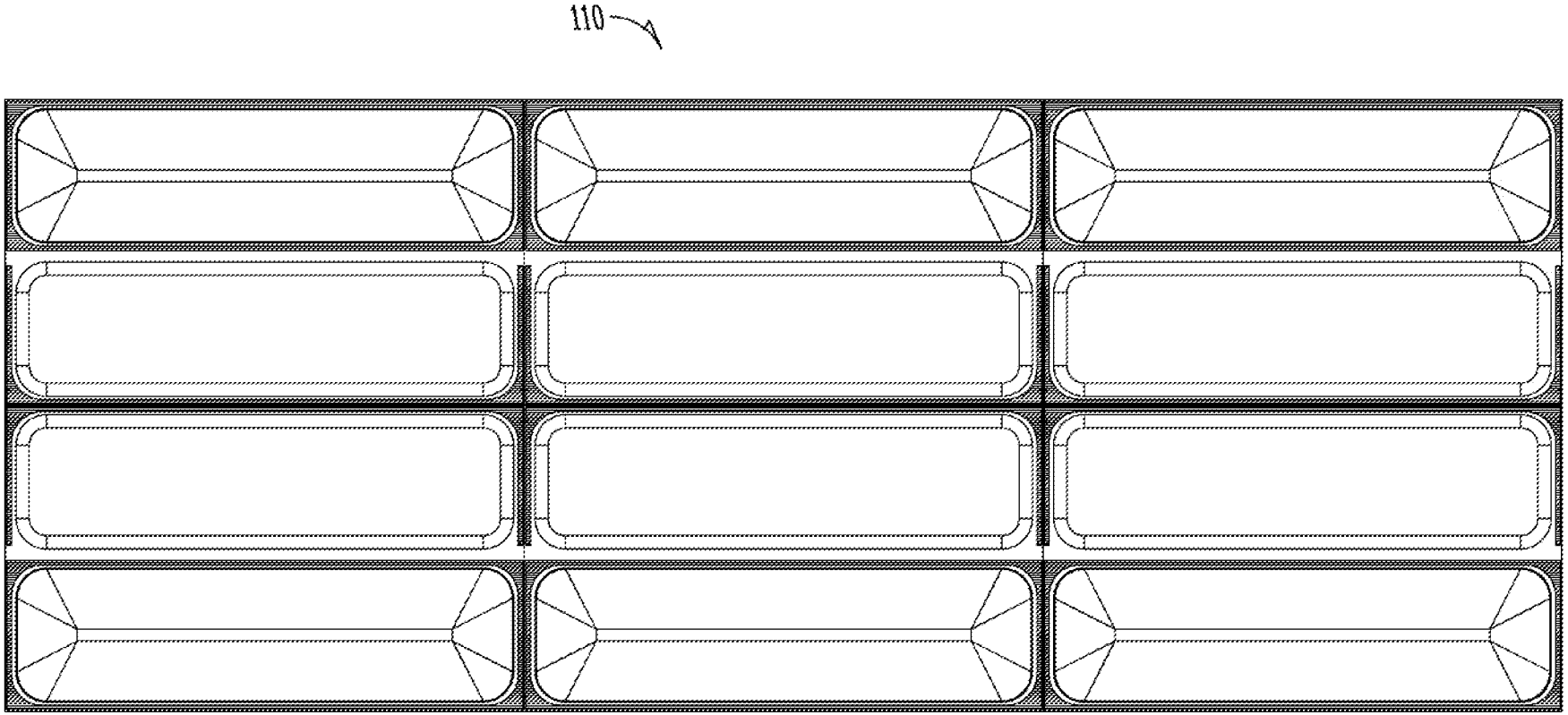
FIG. 13 is an exemplary view of a plurality of product packages formed from a sheet of film according to exemplary aspects of the disclosure.

FIG. 13 is a sheet of packages 110. For example, a single sheet of film can be used to comprise a plurality of packages and according to any of the embodiments disclosed herein. A single sheet of film could thus be started and could then be depressed to form compartments of varying depths and/or shapes, which account for the different compartments and pouches as have been disclosed herein. The packages could then be cut along the flanges to separate the plurality of packages into individual packages which can then be utilized to house one or more products as has been shown and/or described herein. Alternatively, the packaging can be made individually and not as a sheet with multiple packages being formed together.

Therefore, product packaging has been shown and described including a plurality of compartments, with the product compartments including modified and non-modified atmosphere therein. The use of modified and/or non-modified packing allows for products of different compositions and different needs to be stored in the different compartments to increase the self-life of the products stored in the packaging. Furthermore, alternatives to that shown and described herein are to be included as part of the disclosure. For example, the film could have a UV barrier to prevent damage caused by any ultra-violet rays. Furthermore, the film could take many opaqueness levels, from being completely clear, to being completely colored such that no color is allowed in or out. This could further improve the self-life of the products stored therein, especially when the product is a perishable product. Additional alternatives may be considered part of the disclosure which are obvious to those skilled in the art, and the invention is not to be limited to the specific examples disclosed herein.

As would be apparent to one of ordinary skill in the art, mechanical, procedural, or other changes may be made without departing from the spirit and scope of the invention. The scope of the invention is defined only by the appended claims, along with the full scope of equivalents to which such claims are entitled. From the foregoing, it can be seen that the invention accomplishes at least all of the stated objectives.

The present disclosure is not to be limited to the particular embodiments described herein. The following claims set forth a number of the embodiments of the present disclosure with greater particularity.

The invention claimed is:

1. A food product packaging, comprising:

a first compartment comprising a first pouch and a first cover sealed to the first compartment; and a second compartment connected to the first compartment and comprising a second pouch and a second cover operatively attached to the second pouch;

wherein the first sealed compartment comprises a modified atmosphere and the second compartment comprising a non-modified atmosphere; and wherein the second pouch formed between the first cover of the first pouch and the second cover of the second pouch;

wherein said second compartment having a depth that is less than that of the first compartment.

2. The food product packaging of claim 1, wherein the first compartment and the second compartment are connected by a hinge.

3. The food product packaging of claim 2, wherein the hinge comprises a living hinge.

4. The food product packaging of claim 1, wherein the first cover and the second cover comprise a single piece of material.

5. The food product packaging of claim 4, wherein the second cover is operatively attached to the second pouch by a plurality of unconnected seals about the periphery of the second pouch.

6. The food product packaging of claim 1, further comprising a label operatively connected to the packaging.

7. The food product packaging of claim 1, wherein the first cover is sealed to the first pouch by way of a resealable adhesive.

8. The food product packaging of claim 1, further comprising one or more pre-cut tear notches at the first and/or second compartment to provide access thereinto.

9. The food product packaging of claim 1, wherein the first and second compartments comprise a flexible film with a high barrier to moisture and oxygen.

10. The food product packaging of claim 1, wherein the first cover is positioned between the first and the second compartments.

* * * * *